United States Patent [19]

Slocum

[11] Patent Number: 5,044,106

[45] Date of Patent: Sep. 3, 1991

[54] SAFETY DEVICE FOR FIREARMS

[76] Inventor: Timothy H. Slocum, 171 S. Cedar St., Geneva, Ohio 44041

[21] Appl. No.: 603,177

[22] Filed: Oct. 25, 1990

[51] Int. Cl.[5] ..... F41A 17/44

[52] U.S. Cl. ..... 42/70.11; 211/64

[58] Field of Search ..... 42/70.11, 95, 96; 224/912, 913; 211/64

[56] References Cited

U.S. PATENT DOCUMENTS

| | | | |
|---|---|---|---|
| 2,765,107 | 10/1956 | Browning | 224/912 |
| 3,137,957 | 6/1964 | Ingalls | 42/95 |
| 3,307,755 | 3/1967 | Lentz | 42/70.11 |
| 3,353,728 | 11/1967 | Freed | 224/912 |
| 3,368,297 | 2/1968 | Lentz | 42/70.11 |
| 3,497,077 | 2/1970 | Sjostrand | 211/64 |
| 3,708,901 | 1/1973 | Wolter | 42/70.11 |
| 3,710,490 | 1/1973 | Cornett et al. | 42/70.11 |
| 3,720,014 | 3/1973 | Goodrich | 42/70.11 |
| 3,802,612 | 4/1974 | Smith | 211/64 |
| 4,136,476 | 1/1979 | Hetrick | 42/70.11 |
| 4,271,969 | 6/1981 | Gnesa | 211/64 |

*Primary Examiner*—Michael J. Carone

*Attorney, Agent, or Firm*—D. Peter Hochberg; Mark Kusner; Louis J. Weisz

[57] ABSTRACT

A safety device for quickly and easily rendering a firearm unloadable by obstructing the barrel of the firearm. The device includes tow generally elongated rods, each rod having a pin dimensioned to be received in one of firearm and an arm having a plurality of apertures therethrough, at least one aperture on one rod being alignable with an aperture on the other rod. The arms of the two rods are dimensioned to overlap when the pins are positioned within the barrel of the firearm. A bolt of a lock may then be passed through a pair of aligned apertures, one on each of the two rods, so that the pins of the rods may not be removed from the barrel.

22 Claims, 5 Drawing Sheets

SAFETY DEVICE FOR FIREARMS

FIELD OF INVENTION

The present invention relates generally to a safety device for firearms and more particularly to a device for obstructing the barrel of a firearm so as to prevent a shell from being loaded therein.

BACKGROUND OF THE INVENTION

Numerous safety devices for use with firearms are known. Such devices typically are of two types, i.e. trigger locking devices and barrel locking devices. Trigger locking devices generally attach to the trigger of the firearm to prevent movement of the trigger and in turn to prevent release of the hammer. A problem with such devices is that even with the device in place, the firearm can still be loaded with a shell. Hence the firearm is not completely safe from tampering or accidental discharge. These devices also have the added limitation of being generally restricted for use with only the particular firearm for which they are designed.

The second type of safety device, i.e., the barrel locking devices, are generally comprised of plugs or the like which are inserted and locked into the barrel of a firearm so as to render the firearm unloadable. While these devices prevent a shell from being loaded into the barrel, a problem with some of these devices is that they include rather complicated mechanisms and require intricate installation procedures.

U.S. Pat. No. 3,708,901 to Wolter discloses a firearm safety device comprised of a cartridge-like sleeve dimensioned to be inserted into the breech end of the barrel of the firearm and a plug dimensioned to be inserted into the muzzle end of the barrel. A cord extends through the barrel of the firearm between the sleeve and the plug. The cord is biased toward the sleeve to draw the plug into the muzzle end of the barrel to obstruct the same. A special key and particular knowledge are required for removal of the device. A problem with the disclosed device is that it is not truly "locked" onto the firearm, and it is possible to pry the plug out of the barrel and remove the device from the firearm.

U.S. Pat. No. 3,710,490 to Cornett et al. discloses a similar type of safety device including a cartridge-type insert and a plug which are connectable by a cable. The length of the cable is adjustable to correspond to the length of the barrel of the particular firearm to which the device is to be attached. While the disclosed device includes a locking mechanism to secure the device to the firearm, the device includes a considerable number of components, and involves a fairly complicated operation, consisting of numerous steps, to install the device on a firearm. In this respect, the time consuming and lengthy installation procedures associated with the foregoing devices, may make their use less desirable.

U.S Pat. No. 3,368,297 to Lentz discloses a firearm safety device which simultaneously blocks the barrel of a firearm while being locked at the trigger of the firearm. This device includes a generally U-shaped rod, a portion of which is inserted into the barrel of the firearm. Another portion of the rod is locked at the trigger of the firearm. A major drawback of such a device is that it may only be used for a specifically dimensioned firearm in that the respective portions of the rod must be dimensioned to correspond to the lenght of the barrel of the specific firearm. Additionally, as in the case of basic trigger locking devices, even with such a device in place, a shell can still be inserted into the breech end of the firearm.

The present invention overcomes these and other problems by providing a firearm safety device which can be quickly and easily inserted into the barrel of a firearm and locked to the firearm so as to prevent a shell from being loaded therein, and which device is adjustable for use on firearms of varying sizes.

SUMMARY OF THE INVENTION

In accordance with one aspect of the present invention, there is provided a safety device for attachment to a firearm comprising two elongated rods each having a pin at one end and an elongated arm portion generally defining the other end. The pin of each rod is dimensioned to be received in one end of the barrel of a firearm. The rods are dimensioned so that when the pins are inserted in the ends of the barrel of the firearm, the arm portions are generally aligned and overlapping, the length of the overlap being dependent on the length of the barrel of the firearm. The arm portion of each rod includes a plurality of apertures. The apertures are dimensioned and positioned such that when the pins are inserted into the respective ends of the barrel, at least one aperture on one rod may be placed in registry with an aperture on other rod, wherein a fastening means such as a lock, extending through the apertures locks the rods to each other and onto the gun so as to render the firearm unloadable.

In accordance with another apsect of the present invention, there is provided a device as described above further comprising a sleeve having an aperture therethrough, which sleeve is operable to be fitted over the arm portions of both rods wherein the aperture in the sleeve and one aperture in each rod may be aligned with respect to each other. A conventional lock may then be used to lock the rods and sleeve together after the device has been attached to the firearm.

In accordance with a further aspect of the present invention, there is provided a device as described above wherein the two rods are identical and the arm portions of the rods are shaped so that they are disposed in a side-by-side relationship when the device is secured to a firearm.

An object of the present invention is to provide a safety device for attachment to a firearm which prevents a shell from being loaded in the barrel of the firearm.

Another object of the present invention is to provide a safety device as described above which is positioned outside of the firearm and which is locked externally and independently of the firearm.

Another object of the present invention is to provide a firearm safety device as described above, for insertion into the ends of the barrel of a firearm, which is capable of quick and easy affixation on a firearm to render the firearm unloadable.

A further object of the present invention is to provide a firearm safety device as described above, that is difficult to remove in the absence of the proper key or the like.

A further object of the invention is to provide a firearm safety device as described above which is adaptable for use on conventional firearms having barrels of varying sizes.

A still further object of the present invention is to provide a firearm safety device as described above which will not damage the interior of the barrel of the firearm.

A still further object of the present invention is to provide a firearm safety device which is inexpensive to manufacture and easy to use.

These and other objects and advantages will become apparent from the following description of preferred embodiments taken together with the accompanying drawings.

BRIEF DESCRIPTION OF THE DRAWINGS

The invention may take physical form in certain parts and arrangements of parts, a prefered embodiment of which will be described in detail in this specification and illustrated in the accompanying drawings which form a part hereto and wherein.

DETAILED DESCRIPTION OF THE PREFERRED EMBODIMENT

Figure 1:
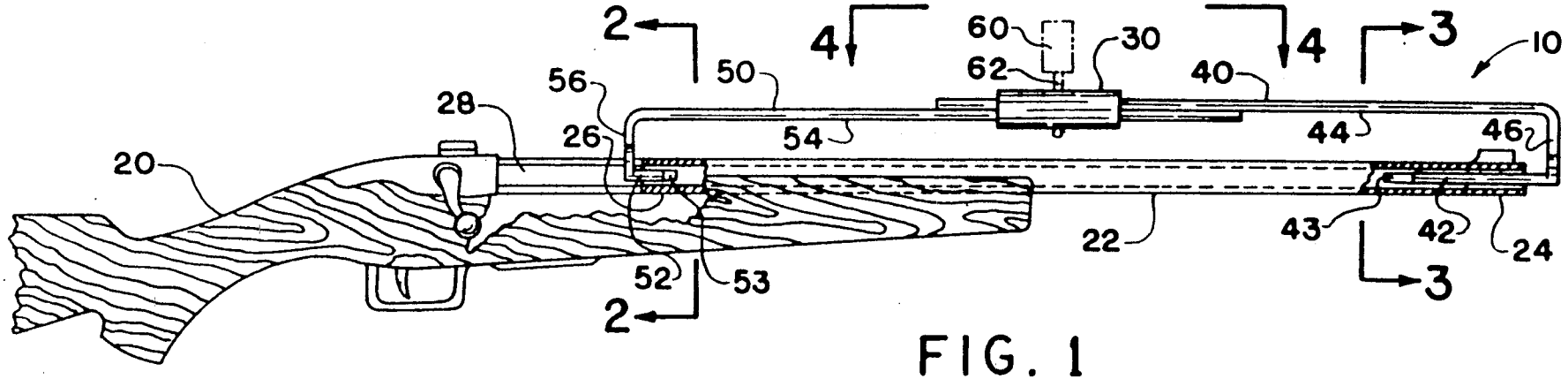
FIG. 1 is a partially sectioned, elevational view showing a firearm safety device according to the present invention mounted in a locked position on a conventional rifle.

Referring now to the drawings wherein the showings are for the purpose of illustrating preferred embodiments of the invention only and not for the purpose of limiting the same, FIG. 1 illustrates a firearm safety device 10 according to the present invention, in position on a typical rifle 20. Rifle 20 in and of itself forms no part of the present invention, and is described solely for the purpose of illustrating application of the present invention, it being understood that the present invention finds advantageous application to other types of firearms such as shotguns and pistols. Rifle 20 includes a barrel 22 having a muzzle end 24, a breech end 26 and a bolt opening 28 adjacent breech end 26.

Figure 5:
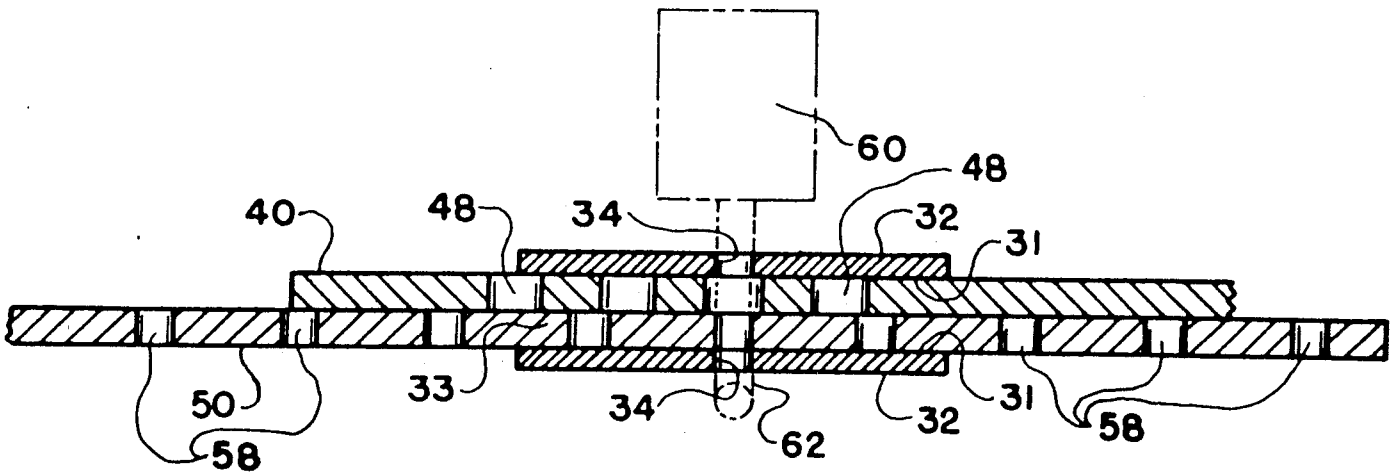
FIG. 5 is a sectional view taken substantially along the line 5—5 of FIG. 4.
Figure 6:
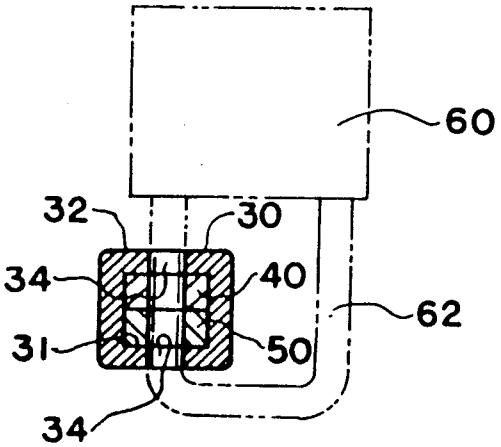
FIG. 6 is a sectional view taken substantially along the line 6—6 of FIG. 4.

According to the present invention, firearm safety device 10 is generally comprised of a sleeve 30, a first rod 40 and a second rod 50. Sleeve 30 is a generally tubular in shape and has an inner surface 31 and an outer surface 32 as best seen in FIGS. 5 and 6. Inner surface 31 of sleeve 30 defines an opening 33 dimensioned to receive simultaneously both first and second rods 40 and 50, as will be described in greater detail below. In the embodiment shown, sleeve 30 and opening 33 are generally rectangular in cross-section as illustrated in FIG. 6. An aperture 34 extends completely through the inner and outer surfaces of sleeve 30 as best seen in FIG. 5.

Figure 3:
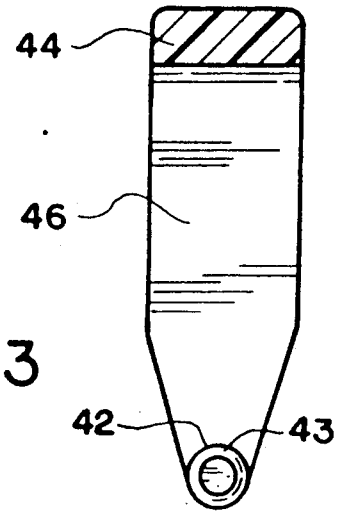
FIG. 3 is a sectional view taken substantially along the line 3—3 of FIG. 1, not including the firearm itself.

First rod 40 is generally elongated and is comprised of a pin 42, an elongated arm portion 44 and a connecting portion 46 which connects pin 42 to the arm portion 44, as shown in FIG. 1. Pin 42 is of circular cross-section and dimensioned to be received within the bore of barrel 22. The end of pin 42 includes a tapered portion 43 to facilitate entry of pin 42 in muzzle end 24 of barrel 22. In the embodiment shown, arm portion 44 is generally rectangular in cross-section as best seen in FIG. 3. Pin 42, arm portion 44 and connecting portion 46 are preferably integrally formed, with pin 42 and arm portion 44 extending from connecting portion 46 and being generally parallel to each other. In this respect, pin 42 and arm portion 44 are dimensioned such that when pin 42 is inserted into a barrel of a firearm, arm portion 44 is generally parallel to the barrel of the firearm and extends along a major portion thereof. According to the present invention, the free end of arm portion 44 includes a plurality of aligned, spaced apart apertures 48 which extend therethrough. Apertures 48 are generally aligned along the longitudinal axis of arm portion 44.

Figure 2:
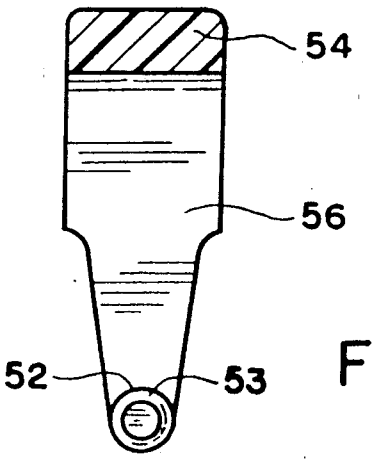
FIG. 2 is a sectional view taken substantially along the line 2—2 of FIG. 1, not including the firearm itself.
Figure 4:
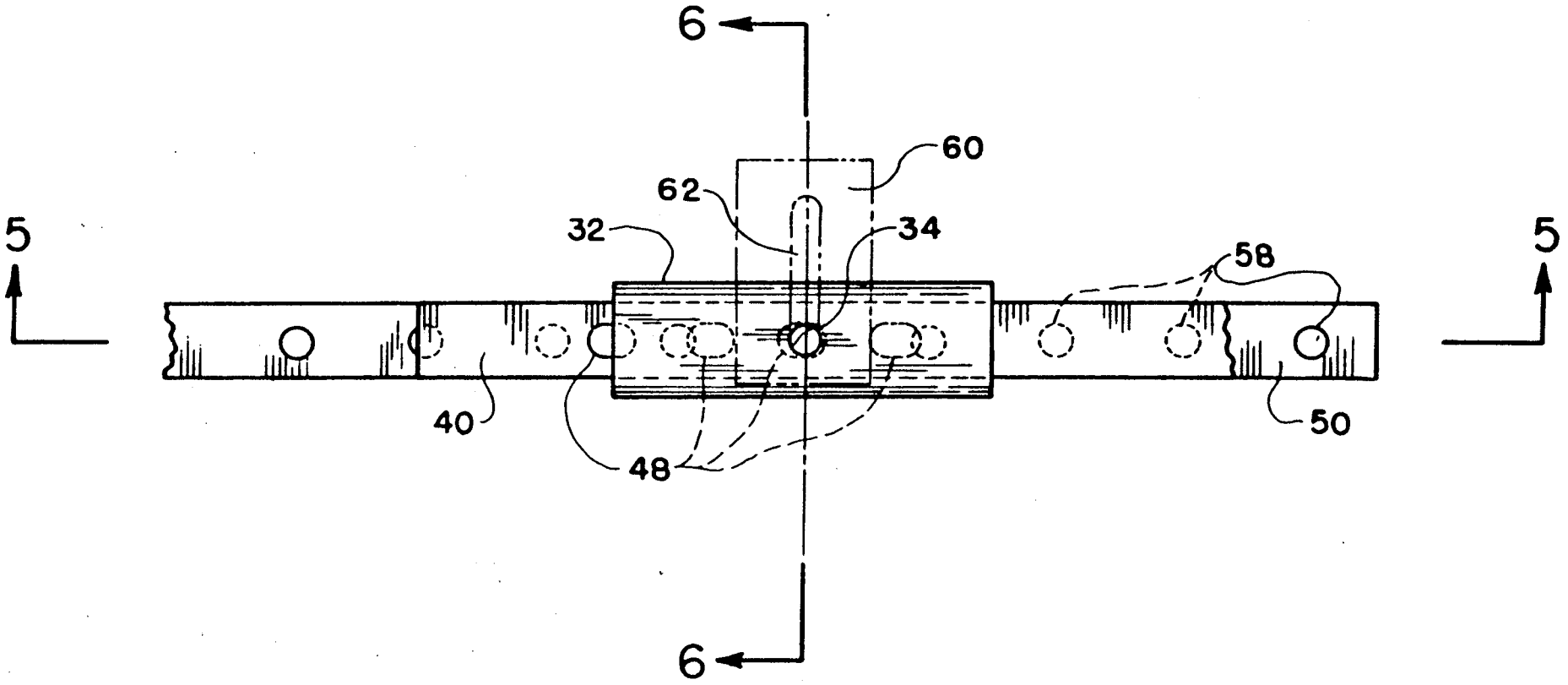
FIG. 4 is a plan view taken along line 4—4 of FIG. 1 showing the apertures in both the rods and the aperture in the sleeve.

Second rod 50 comprises a pin 52, an arm portion 54 and a connecting portion 56. Pin 52 of second rod 50, is dimensioned to be received within the bore of barrel 22. Pin 52 is of circular cross-section and has a tapered portion 53 to facilitate entry thereof into breech end 26 of barrel 22. In the embodiment shown, arm portion 54 is generally rectangular in cross-section as best seen in FIG. 2. Pin 52, arm portion 54 and connecting portion 56 are preferably integrally formed, with pin 52 and arm portion 54 extending from connecting portion 56 and being generally parallel to each other. In this respect, pin 52 and arm portion 54 are dimensioned such that when pin 52 is inserted into the barrel of a firearm, arm portion 54 is generally parallel to the barrel of the firearm and extends along a major portion thereof. In the embodiment shown, the length of pin 52 of the second rod is substantially shorter than pin 42 of rod 40. In this respect pin 52 is dimensioned to permit insertion thereof in bolt opening 28. According to the present invention, the free end of arm portion 54 includes a plurality of aligned, spaced-apart apertures 58 which extend therethrough as seen in FIGS. 4, 5 and 6. Apertures 58 are generally aligned along the longitudinal axis of arm portion 54. In the embodiment shown, connecting portion 56 of second rod 50 is slightly shorter than the connecting portion 46 of and 252

Importantly, arm portions 44 and 54 are dimensioned to extend along barrel 22, albeit in opposite directions, and to overlap. For a given device, the extent of overlap depends primarily on the length of the barrel of the firearm to which the firearm safety device is applied. Arm portions 44, 54 are preferably dimensioned so as to accommodate use with barrels 22 of varying lengths. Apertures 48 and 58 on the arm portions 40, 50 are positioned so that at least one of the aperture 48 on the overlapping portion of arm portion 44 may be aligned, and in registry, with one aperture 58 on the overlapping portion of arm portion 54 when pins 42, 52 are within the barrel of a firearm. In the embodiment shown, best seen in FIG. 4, apertures 58 on second rod 50 are circular whereas apertures 48 on first rod 40 are oval, facilitating alignment of the apertures.

Accordding to the present invention, first and second rods 40 and 50 and sleeve 30 are preferably formed of a rigid, yet non-abrasive material so as to allow for a completely integral construction. In the embodiment shown, rods 40, 50 are preferably molded as single pieces. The rods 40, 50 are preferably formed of glass fiber reinforced plastic (FRP). Other materials such as thermosetting resins, polyester, epoxy phenolic polypropylene, polystyrene, nylon polycarbontes and polyphenylene oxides may also be used.

Referring now to the use of the present embodiment, there is provided a safety device 10 for quickly and easily rendering a firearm unloadable. Safety device 10 is installed on firearm 20 by inserting pin 42 of first rod 40 into muzzle end 24 of the barrel 22. Sleeve 30 is preferably positioned on arm portion 44, near connecting portion 46. Pin 52 of second rod 50 is then inserted through bolt opening 28 into breech end 26 of barrel 22. As shown in FIGS. 1, 4, 5 and 6 free ends of arm portions 44, 54 overlap a certain amount depending on the length of barrel 22. Rods 40, 50 are adjustable with respect to each other and with respect to barrel 22 of the firearm so as to permit alignment of an aperture 48 on first rod 40 with an aperture 58 on second rod 50. In this respect, connecting portions 46 and 56 of rods 40 and 50 respectively, need not abut against muzzle end 24 and breech end 26 respectively of the firearm, but are preferably positioned relative to such ends so as to allow for adjustability and to avoid damage to the barrel (see FIG. 1). Importantly, the lengths of pins 42, 52 of rods 40, 50 are of sufficient length to permit adjustability between the respective rods and to facilitate minor adjustments required to align slightly misaligned apertures. In this respect, the relative shapes of the apertures 48 (oval) as opposed to apertures 58 (circular) also allow for adjustment, albeit of a finer nature (See FIGS. 4 and 5). It will be appreciated that apertures 48, 58 on rods 40, 50 are not limited to being oral or circular. Sleeve 30 is positioned over the overlapping portions of rods 40, 50 such that apertures 34 therein is aligned with the aligned apertures 48, 58 of rods 40, 50. A bolt 62 of a conventionally-known key lock or combination lock 60, shown in phantom in the drawings, may then be passed through aligned apertures 48, 58 and 34 and locked in a well-known manner, thereby fastening device 10 onto rifle 20 and rendering the firearm unloadable until the lock is removed. Moreover, the present invention provides a firearm safety device 10 which may be used with firearms of varying barrel lengths, as a result of the adjustability of rods 40, 50. Still further, device 10 is locked remote from and externally of the firearm, which facilitates simplicity and ease of installation.

Figure 7:
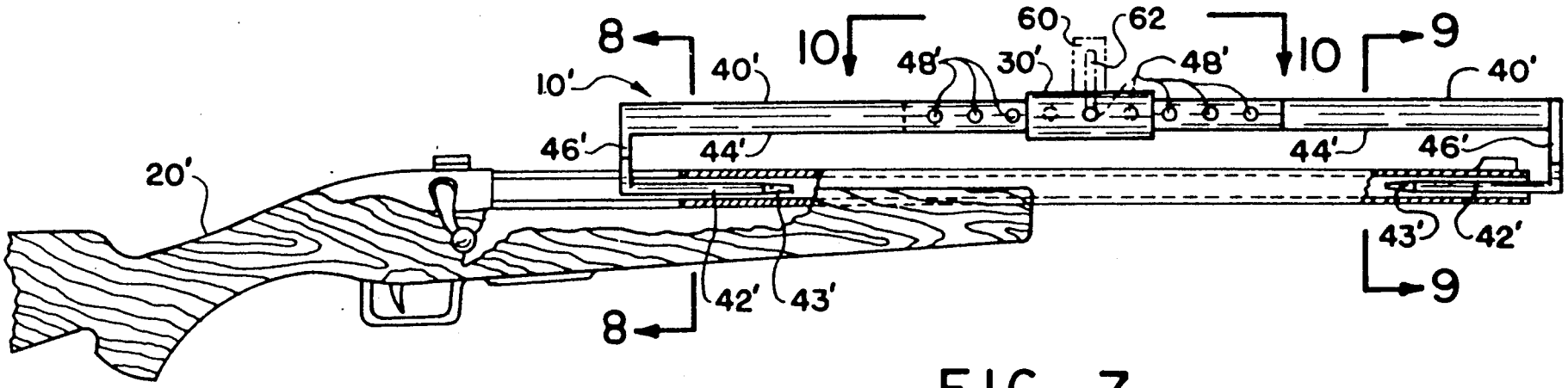
FIG. 7 is partially sectioned, elevational view showing a firearm safety device illustrating another embodiment of the present invention, mounted in a locked position on a conventional rifle.
Figure 9:
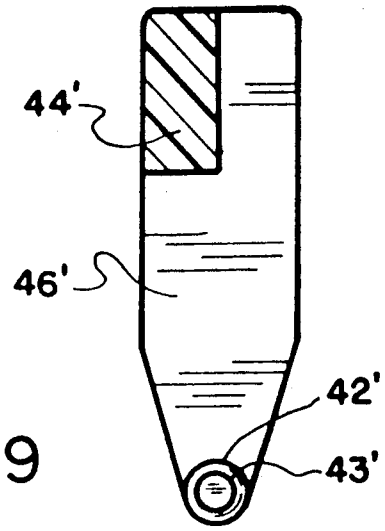
FIG. 9 is a sectional view taken substantially along the line 9—9 of FIG. 7, not including the firearm itself.
Figure 10:
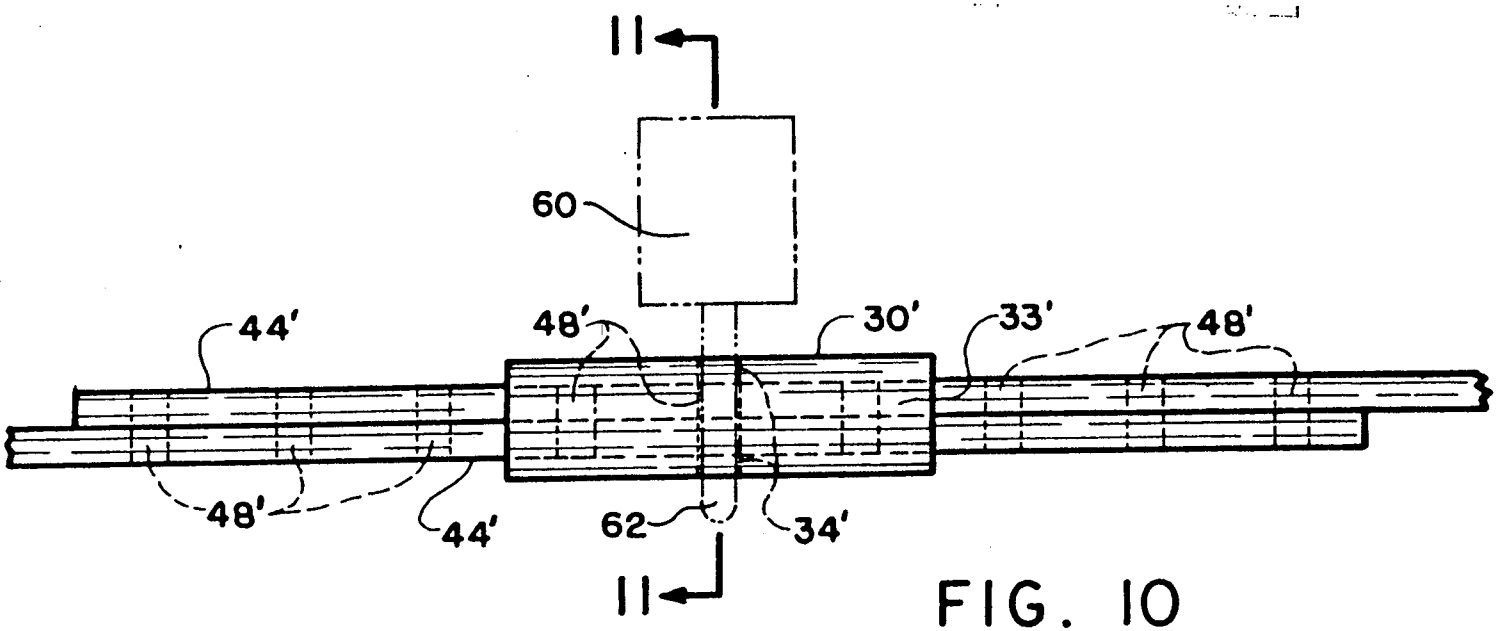
FIG. 10 is a view taken along line 10—10 of FIG. 7.

Referring now to FIGS. 7–11, an alternate embodiment of the present invention is shown. FIG. 7 illustrates a firearm safety device 10' in position on a firearm 20'. According to this embodiment, firearm safety device 10' is generally comprised of a sleeve 30' and two identical rods 40'. Sleeve 30' is generally tubular in shape and has an inner surface 31' and an outer surface 32'. Inner surface 31' defines an opening 33' dimensioned to receive simultaneously, parts of arms 44' of both identical rods 40'. Sleeve 30' and opening 33' are generally rectangular in cross-section as best seen in FIG. 10, to conform to the shape of arms 44'. An aperture 34' extends completely through the inner and outer surfaces of sleeve 30' as best seen in FIG. 10.

Figure 8:
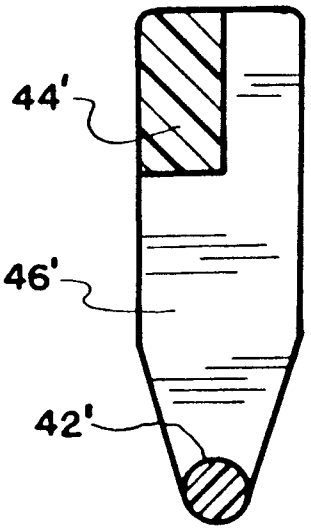
FIG. 8 is a sectional view taken substantially along the line 8—8 of FIG. 7, not including the firearm itself.
Figure 11:
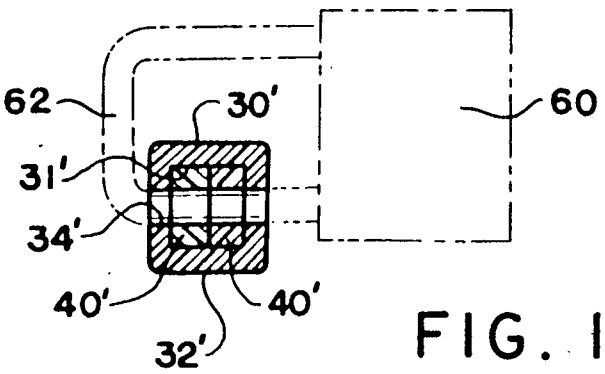
FIG. 11 is a sectional view taken substantially along the line 11—11 of FIG. 10.

Rods 40' are each elongated and comprised of a pin 42', an elongated arm portion 44' and a connecting portion 46' as best seen in FIG. 7. Pins 42' are of circular cross-section and dimensioned be received within the bore of the barrel of the firearm. The ends of pins 42' away from connecting portions 46' include a tapered portion 43' to facilitate entry of pins 42' into the barrel. Arm portions 44' are joined with connecting portions 46', generally on one side of the longitudinal axes of connecting portions 46', as best seen in FIGS. 8 and 9. Arm portions 44' are generally rectangular in cross-section as best seen in FIG. 11. Additionally, pins 42', arm portions 44' and connection portions 46' are preferaby integrally formed, with pins 42' and arm portions 44', of each arm, extending from connecting portion 46' and being generally parallel to each other. In this respect pins 42' and arm portions 44' are dimensioned such that when pins 42' are inserted into the barrel of a firearm, arm portions 44' are generally parallel to the barrel and extend along a major portion thereof, thereby causing arm portions 44' to overlap with each other. The extent of overlap depends primarily on the length of the barrel of the firearm to which the safety device is applied. Also, connecting portions 46' need not be in registry with the ends of the firearm but may be preferably positioned at a distance from the same so as to allow for adjustability. According to the present embodiment, arm portions 44' include a plurality of aligned, spaced apart apertures 48' which extend therethrough, aligned generally along the longitudinal axes thereof. In the present embodiment, apertures 48' on arm portions 44' are circular.

Referring now to the operation of the embodiment shown in FIGS. 7–11, as will be appreciated, the steps involved in assembling device 10' are basically the same as those discussed above for the previous embodiment. Importantly, however, a firearm safety device 10' according to the present embodiment would, in addition to providing the advantages of the first embodiment, be appreciably cheaper to manufacture, due to the economy which would be achieved in forming identical rods 40'.

The present embodiment has been described with respect to preferred embodiments Modifications and alterations will occur to others upon the reading and understanding of the specification. It is intended that all such modifications and alterations be included insofar as they come within the scope of the invention as claimed or equivalents thereof.

Having thus described the invention, the following is claimed:

1. A safety device for obstructing the barrel of a firearm comprising:

an elongated first rod including a pin dimensioned to be received into the breech end of said barrel of said firearm and an elongated arm portion spaced apart from and generally parallel to said pin, said arm portion having a plurality of apertures therethrough; and an elongated second rod including a pin dimensioned to be received into the muzzle end of said barrel and an elongated arm portion spaced apart from and generally parallel to said pin, said arm portion having a plurality of apertures therethrough, said first and second rods being dimensioned so that when said pins of said first and second rods are received in the barrel of said firearm, said elongated arm portions are in a side-by-side relationship wherein at least one of said apertures on said arm portion of said first rod may be aligned to be in registry with one aperture on said arm portion of said second rod.

2. A safety device for obstructing the barrel of a firearm comprising:

an elongated first rod including a pin dimensioned to be received into the breech end of said barrel of said firearm and an elongated arm portion spaced apart from and generally parallel to said pin, said arm portion having a a plurality of apertures therethrough;

an elongated second rod including a pin dimensioned to be received into the muzzle end of said barrel and an elongated arm portion spaced apart from and generally parallel to said pin, said arm portion having a plurality of apertures therethrough; and a generally tubular sleeve comprising an outside surface, an inner surface and a radial aperture through said inside and outside surfaces, said inner surface defining an opening dimensioned to receive said arm portions of said first and second rods, said rods being dimensioned such that when said pin of said first rod is received in said breech end of said barrel of said firearm, said opening of said sleeve is slidable over said arm portion of said first rod, said arm portion of said second rod being insertable into said opening of said sleeve simultaneously with said arm portion of said first rod, said pin of said second rod being simultaneously insertable into said muzzle end of said barrel, wherein at least one of said apertures on said arm portion of said first rod is coaxial with one aperture on said arm portion of said second rod, said sleeve being slidable over said two free ends of said first and second rods so as to cause said radial aperture in said sleeve to be coaxial with said coaxial pair of apertures on said rods, said three apertures being dimensioned to receive a conventional lock therethrough.

3. A safety device as in claim 1 wherein both said first and second rods are generally J-shaped.

4. A safety device as in claim 1 wherein said apertures on both said free ends of both said rods are identically dimensioned.

5. A safety device as in claim 1 wherein said apertures on first said free end of said first rod are circular whereas said apertures on said second rod are oval.

6. A safety device as in claim 1 wherein said apertures wherein said free end of said first rod are oval whereas said apertures on said second rod are circular.

7. A safety device as in claim 1 wherein said pins of both the first and second rods are circular cross-section and tapered and are constructed of molded plastic so as to facilitate entry of said pins into said barrel and to protect the interior of said barrel of said firearm.

8. A safety device as in claim 1 wherein both said first and second rods are constructed of molded plastic.

9. A safety device as in claim 1 wherein each of said plurality of apertures are positioned to be substantially in the longitudinal center of said free end of said arm portions of said first and second rods respectively.

10. A safety device for obstructing the barrel of a firearm comprising:

a pair of identical elongated rods each further comprising a pin dimensioned to be received into the breech or the muzzle end of said barrel of said firearm and an elongated arm portion spaced apart from and generally parallel to said pin, said arm portion having a plurality of apertures therethrough, so that when said pins of both said rods are received in the barrel of said firearm, said arm portions of said rods are in a side-by-side relationship wherein at least one of said apertures on said arm portion of first said rod is coaxial with one aperture on said arm portion of second said rod, said coaxial pair being dimensioned to receive a conventional lock therethrough.

11. A safety device for obstructing the barrel of a firearm comprising:

a pair of identical elongated rods each further comprising a pin dimensioned to be received into the breech or the muzzle end of said barrel of said firearm and an elongated arm portion spaced apart from and generally parallel to said pin, said arm portion having a plurality of apertures therethrough; and a generally tubular sleeve comprising an outside surface, an inner surface and a radial aperture through said inside and outside surfaces, said inner surface defining an opening dimensioned to receive said arm portions of said identical rods.

said rods being dimensioned such that when said pin of first rod is received in breech end of said barrel of said firearm, said opening of said sleeve is slidable over said arm portion of first said rod, said arm portion of second said rod being insertable into said opening of said sleeve simultaneously with said arm portion of first said rod, said pin of second said rod being simultaneously insertable into said muzzle end of said barrel, wherein at least one of said apertures on said arm portion of first said rod is coaxial with one aperture on said arm portion of second said rod, said sleeve being slidable over said two arm portions of said rods so as to cause said radial aperture in said sleeve to be coaxial with said coaxial pair of apertures in said rods, said three apertures bein dimensioned to receive a conventional lock therethrough.

12. A safety device as in claim 10 wherein both said rods are generally J-shaped.

13. A safety device as in claim 10 wherein said apertures on both said free ends of both said rods are identically dimensioned.

14. A safety device as in claim 10 wherein said apertures on first said free end of first said rod are circular whereas said apertures on second said rod are oval.

15. A safety device as in claim 10 wherein said apertures wherein said free end of first said rod are oval whereas said apertures on second said rod are circular.

16. A safety device as in claim 10 wherein said pins of both rods are of circular cross-section and tapered and are constructed of molded plastic so as to facilitate entry of said pins into said barrel and to protect the interior of said barrel of said firearm.

17. A safety device as in claim 10 wherein both said rods are constructed of molded plastic.

18. A safety device as in claim 10 wherein each of said plurality of apertures are positioned to be substantially in the longitudinal center of said free end of said arm portions of said first and second rods respectively.

19. A safety device for attachment to a firearm having a barrel and an axial aligned bore extending therethrough comprising:

a pair of elongated rods, each rod including, a pin dimensioned to be received within the barrel of said firearm, an elongated arm portion spaced from and generally parallel to said pin, said arm portion including a plurality of aligned, spaced-apart apertures formed therein, said arm portions dimensioned such that the arm portion of one of said pair of elongated rods overlaps in side-by-side relationship with the arm portion of the other of said pair of elongated rods when said pins are disposed at opposite ends of said barrel, said rods being adjustable relative to each other to align an aperture in one rod with an aperture in the other rod.

20. A safety device as defined in claim 19, further comprising a tubular sleeve having an axially aligned inner bore dimensioned to receive simultaneously said arm portion of said pair of elongated rods, said sleeve including an aperture extending therethrough, said aperture transverse to said bore and disposed to be positioned in registry with said apertures in said arm portions.

21. A safety device as defined in claim 19 wherein said rods are generally J-shaped and integrally formed of a plastic composition.

22. A safety device as defined in claim 19 wherein said rods are identically formed.

* * * * *